US007604095B2

(12) United States Patent
Mitchell

(10) Patent No.: US 7,604,095 B2
(45) Date of Patent: Oct. 20, 2009

(54) THERMAL-ACOUSTIC ENCLOSURE

(75) Inventor: Stephen Craig Mitchell, West Chester, OH (US)

(73) Assignee: General Electric Company, Schenectady, NY (US)

( * ) Notice: Subject to any disclaimer, the term of this patent is extended or adjusted under 35 U.S.C. 154(b) by 393 days.

(21) Appl. No.: 11/444,659

(22) Filed: Jun. 1, 2006

(65) Prior Publication Data

US 2007/0278035 A1 Dec. 6, 2007

(51) Int. Cl.
*E04B 1/82* (2006.01)

(52) U.S. Cl. ..... 181/290; 181/210

(58) Field of Classification Search ..... 181/290, 181/210

See application file for complete search history.

(56) References Cited

U.S. PATENT DOCUMENTS 2,218,965 A * 10/1940 Young et al. ..... 52/144
2,927,665 A * 3/1960 Hauf ..... 52/262
3,037,726 A * 6/1962 Phillips ..... 244/114 B
3,604,530 A * 9/1971 Duthion et al. ..... 181/210
3,616,139 A * 10/1971 Jones ..... 428/118
4,084,367 A * 4/1978 Saylor et al. ..... 428/113
4,257,998 A * 3/1981 Diepenbrock et al. ..... 264/156
4,274,506 A * 6/1981 Blomgren et al. ..... 181/210
4,630,416 A * 12/1986 Lapins et al. ..... 52/239
4,641,726 A * 2/1987 Fearon et al. ..... 181/292
4,686,806 A * 8/1987 Bennett ..... 52/309.4
5,210,984 A * 5/1993 Eckel ..... 52/79.5
5,300,178 A * 4/1994 Nelson et al. ..... 156/292
5,377,534 A * 1/1995 Boet ..... 73/112.01
5,705,769 A * 1/1998 Hanson ..... 114/20.1
5,712,447 A * 1/1998 Hanson ..... 114/20.1
5,907,932 A * 6/1999 LeConte et al. ..... 52/144
6,112,851 A * 9/2000 Sugimoto et al. ..... 181/287
6,722,466 B1 * 4/2004 Tong et al. ..... 181/200
2003/0102184 A1 * 6/2003 Brisson et al. ..... 181/290
2004/0065501 A1 * 4/2004 Tong et al. ..... 181/200

(Continued)

FOREIGN PATENT DOCUMENTS

EP 368135 A1 * 5/1990

OTHER PUBLICATIONS

Mitchell, Stephen, Thermal-Acoustic Enclosure, Filed Nov. 12, 2004, U.S. Appl. No. 10/987,606.

*Primary Examiner*—Jeffrey Donels
*Assistant Examiner*—Forrest M Phillips
(74) *Attorney, Agent, or Firm*—William Scott Andes, Esq.; Armstrong Teasdale LLP

(57) ABSTRACT

An enclosure having at least one wall, the wall includes an inner panel comprising, in sequence outwardly from the enclosure hollow interior, an inner sheet comprising a plurality of perforations extending therethrough, a plurality of panel stiffening members coupled to the inner sheet, and at least one inner panel sound absorption member comprising non-metallic sound absorption material positioned between adjacent of the plurality of panel stiffening members, and an outer panel comprising in sequence inwardly from outside of the enclosure, an outer panel sandwich member comprising non-metallic composite material including spaced-apart first and second walls and a plurality of spaced-apart transverse walls extending between the first and second walls defining hollow chambers therebetween, the outer panel coupled to the inner panel such that an outer surface of the inner panel is substantially flush against an outer surface of the outer panel.

16 Claims, 5 Drawing Sheets

U.S. PATENT DOCUMENTS

2004/0238276 A1* 12/2004 Matias et al. ..... 181/290
2005/0160740 A1* 7/2005 Nakano et al. ..... 60/796
2005/0241877 A1* 11/2005 Czerny et al. ..... 181/293
2006/0042874 A1* 3/2006 Foster et al. ..... 181/285
2006/0102419 A1* 5/2006 Mitchell et al. ..... 181/200
2006/0108175 A1* 5/2006 Surace et al. ..... 181/285
2006/0118357 A1* 6/2006 Braun et al. ..... 181/290
2006/0124388 A1* 6/2006 Pompei ..... 181/290
2007/0278035 A1* 12/2007 Mitchell ..... 181/290

* cited by examiner

THERMAL-ACOUSTIC ENCLOSURE

BACKGROUND OF THE INVENTION

This invention relates to enclosures for apparatus that, during operation, generates heat and sound energy. More particularly, it relates to an enclosure for a turbine engine used for such applications as marine or industrial.

Gas turbine engines used to generate power in marine or industrial applications are required to be contained or packaged in an enclosure to reduce levels of noise or sound energy and heat generated during engine operation, as well as to provide fire protection. Typically, current designs of such enclosures include heavy metal structures based on the theory that mass is the primary factor in sound attenuation and therefore increased mass results in increased sound attenuation or transmission loss. Accordingly, the walls of current enclosures include heavy, solid and porous metal plates with a large number of stiffening beams to achieve a desired sound frequency attenuation. Damping compound is added to provide damping of acoustic energy and reduce heat transmission. The result is a relatively heavy acoustic enclosure.

In some vehicles such as marine vessels, excessive weight of an engine enclosure can require more fuel to propel the vessel. Therefore, it is advantageous and desirable to provide a lightweight enclosure that can include enhanced acoustic characteristics and reduced heat transfer through enclosure walls, along with fire protection.

BRIEF SUMMARY OF THE INVENTION

In one aspect, a method for assembling a gas turbine engine assembly is provided. The method includes coupling a first wall, a second wall, a third wall, and a fourth wall together to form an enclosure, at least one of the first, second, third, or fourth walls including a first panel including an inner layer, an outer layer, and a plurality of spaced-apart transverse walls between the inner and outer layers, and a second panel that includes at least an outer layer and a first acoustic material, the first panel coupled to the second panel such that the outer surface of the first panel is flush against the outer surface of the second panel, and positioning a gas turbine engine within the enclosure such that at least a portion of the gas turbine engine is contained within the enclosure.

In another aspect, an enclosure for an apparatus having at least one wall defining at least a portion of an enclosure hollow interior is provided. The wall includes an inner panel comprising, in sequence outwardly from the enclosure hollow interior, an inner sheet comprising a plurality of perforations extending therethrough, a plurality of panel stiffening members coupled to the inner sheet, and at least one inner panel sound absorption member comprising non-metallic sound absorption material positioned between adjacent of the plurality of panel stiffening members, and an outer panel comprising in sequence inwardly from outside of the enclosure, an outer panel sandwich member comprising non-metallic composite material including spaced-apart first and second walls and a plurality of spaced-apart transverse walls extending between the first and second walls defining hollow chambers therebetween, the outer panel coupled to the inner panel such that an outer surface of the inner panel is substantially flush against an outer surface of the outer panel.

In a further aspect, a gas turbine engine assembly is provided. The gas turbine engine assembly includes an enclosure including a first wall, a second wall, a third wall, and a fourth wall. Each wall includes an inner panel comprising, in sequence outwardly from the enclosure hollow interior, an inner sheet comprising a plurality of perforations extending therethrough, a plurality of panel stiffening members coupled to the inner sheet, and at least one inner panel sound absorption member comprising non-metallic sound absorption material positioned between adjacent of the plurality of panel stiffening members, and an outer panel comprising in sequence inwardly from outside of the enclosure, an outer panel sandwich member comprising non-metallic composite material including spaced-apart first and second walls and a plurality of spaced-apart transverse walls extending between the first and second walls defining hollow chambers therebetween, the outer panel coupled to the inner panel such that an outer surface of the inner panel is substantially flush against an outer surface of the outer panel, and a gas turbine engine positioned within the enclosure.

DETAILED DESCRIPTION OF THE INVENTION

Figure 1:
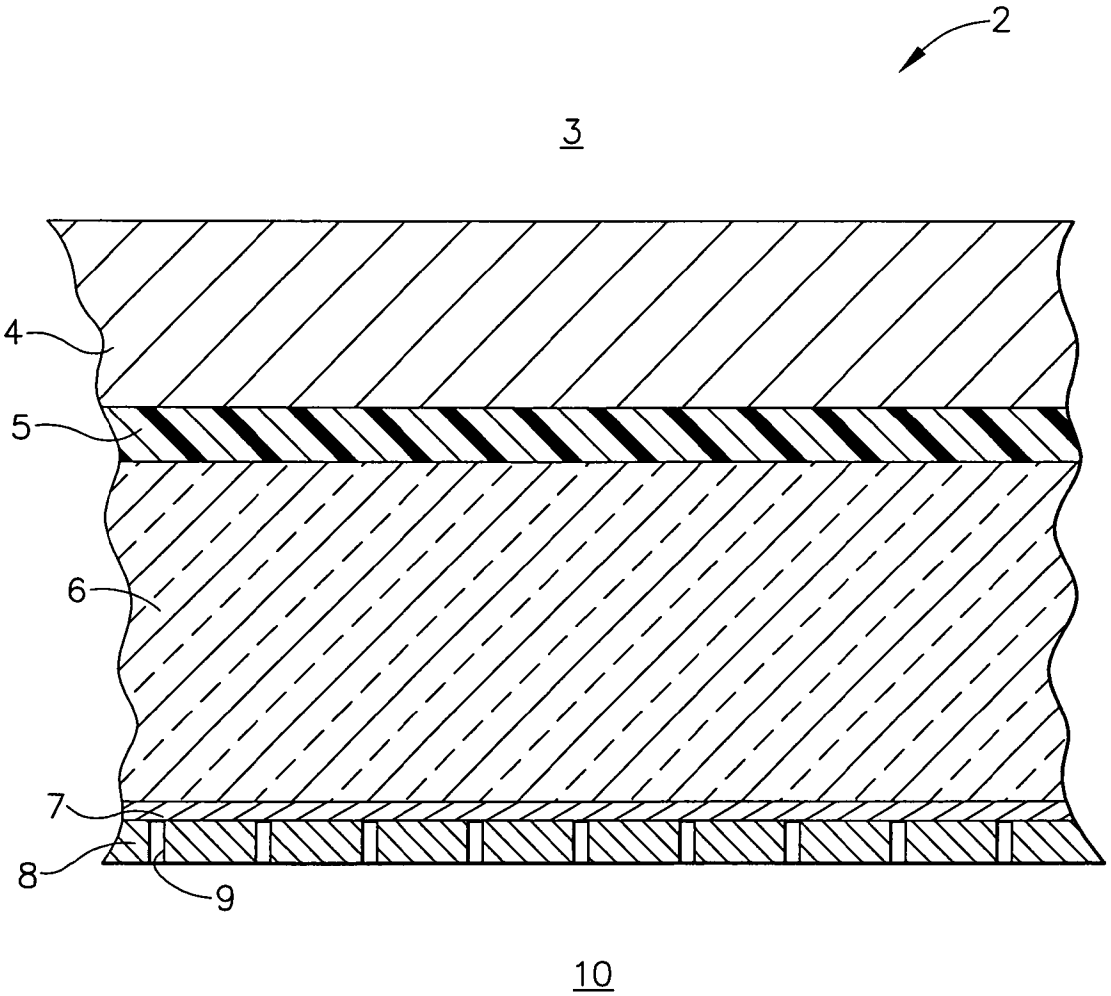
FIG. 1 (PRIOR ART)
FIG. 1 is a diagrammatic, fragmentary sectional view of a current, prior art structure.

Current enclosure designs used to package or house gas turbine engines for use in marine applications provide acoustic transmission loss requirements with heavy metal structures. One form of a wall of such current, prior art enclosures is shown generally at 2 in the diagrammatic, fragmentary sectional view of FIG. 1. Wall 2 includes, in sequence from outside 3 of enclosure wall 2, a heavy metal plate 4, a sprayed-on thick rubber coating material 5, felt batting material 6 (typically including a thin film facing 7) to provide damping of acoustic energy, and a perforated metal face sheet 8 (including pores 9 therethrough) adjacent enclosure inside or enclosure hollow interior 10. Supporting such prior art structure is a large number of heavy metal stiffening beams (not shown). Such current design results in a relatively heavy structure for an enclosure in order to satisfy specified sound energy attenuation requirements.

Forms of the present invention eliminate heavy metal walls and supports by including wall components that are fabricated utilizing primarily non-metallic composite materials, including fiber reinforced composites, to provide high damping and stiffness characteristics to the wall. As a result, a lighter weight support frame can be used to provide a structurally strong, yet lightweight, enclosure that includes enhanced acoustic characteristics and reduced heat transfer through enclosure walls, along with fire protection and in-plane shear loading capabilities.

Figure 2:
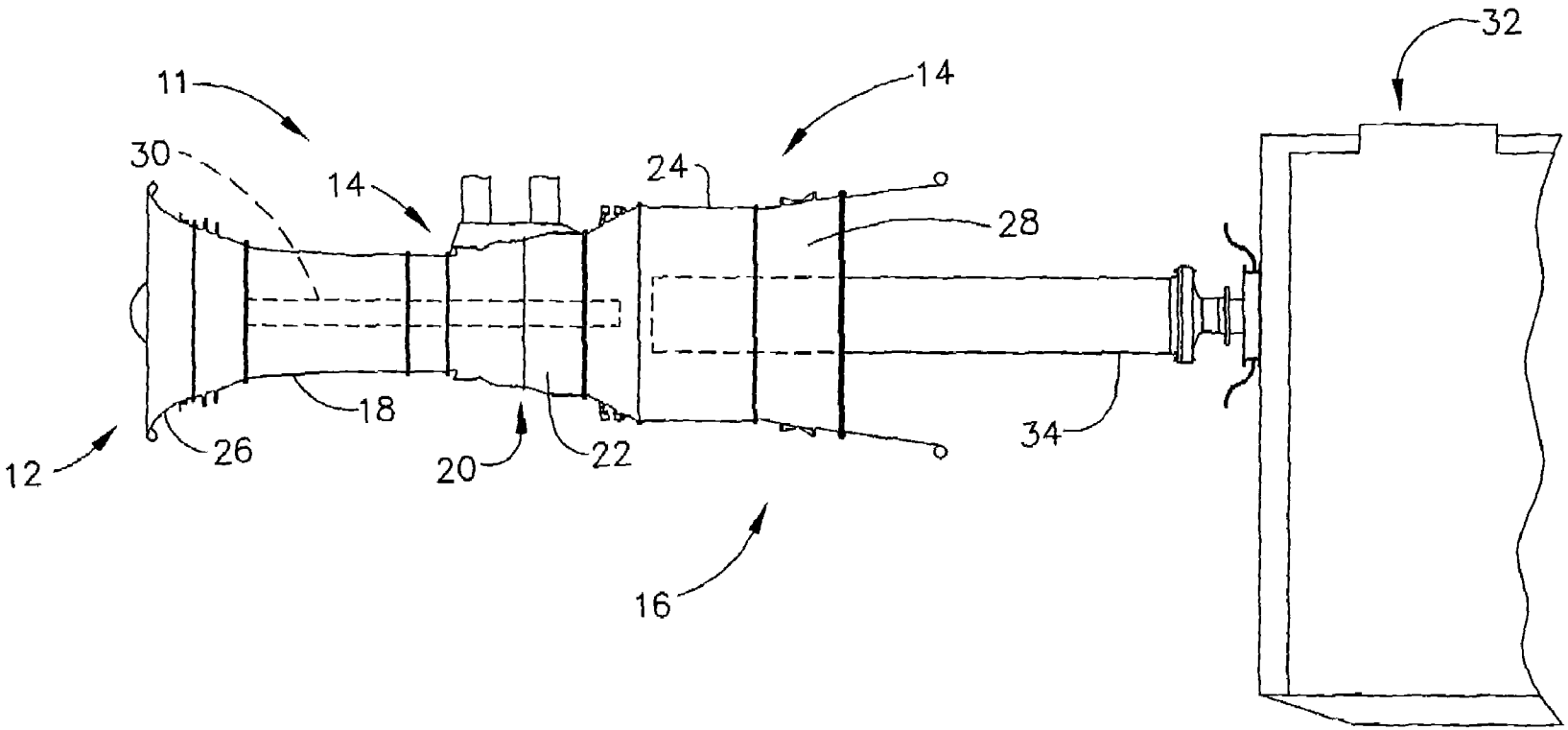
FIG. 2 is a schematic illustration of an exemplary gas turbine engine.

The present invention will be more readily understood by reference to the other figures of the drawing. FIG. 2 is a schematic illustration of an exemplary gas turbine engine 11 including an inlet portion 12, an engine portion 14, and an exhaust portion 16. Engine portion 14 includes at least one compressor 18, a combustor 20, a high pressure turbine 22, and a low pressure turbine 24 connected serially. Inlet portion 12 includes an inlet 26, and exhaust portion 16 includes an exhaust nozzle 28. In one embodiment, engine 11 is an LM2500 engine commercially available from General Electric Company, Cincinnati, Ohio. Compressor 18 and turbine 22 are coupled by a first shaft 30, and turbine 24 and a driven load 32 are coupled by a second shaft 34.

In operation, air flows into engine inlet 26 through compressor 18 and is compressed. Compressed air is then channeled to combustor 20 where it is mixed with fuel and ignited. Airflow from combustor 20 drives rotating turbines 22 and 24 and exits gas turbine engine 11 through exhaust nozzle 28.

Figure 3:
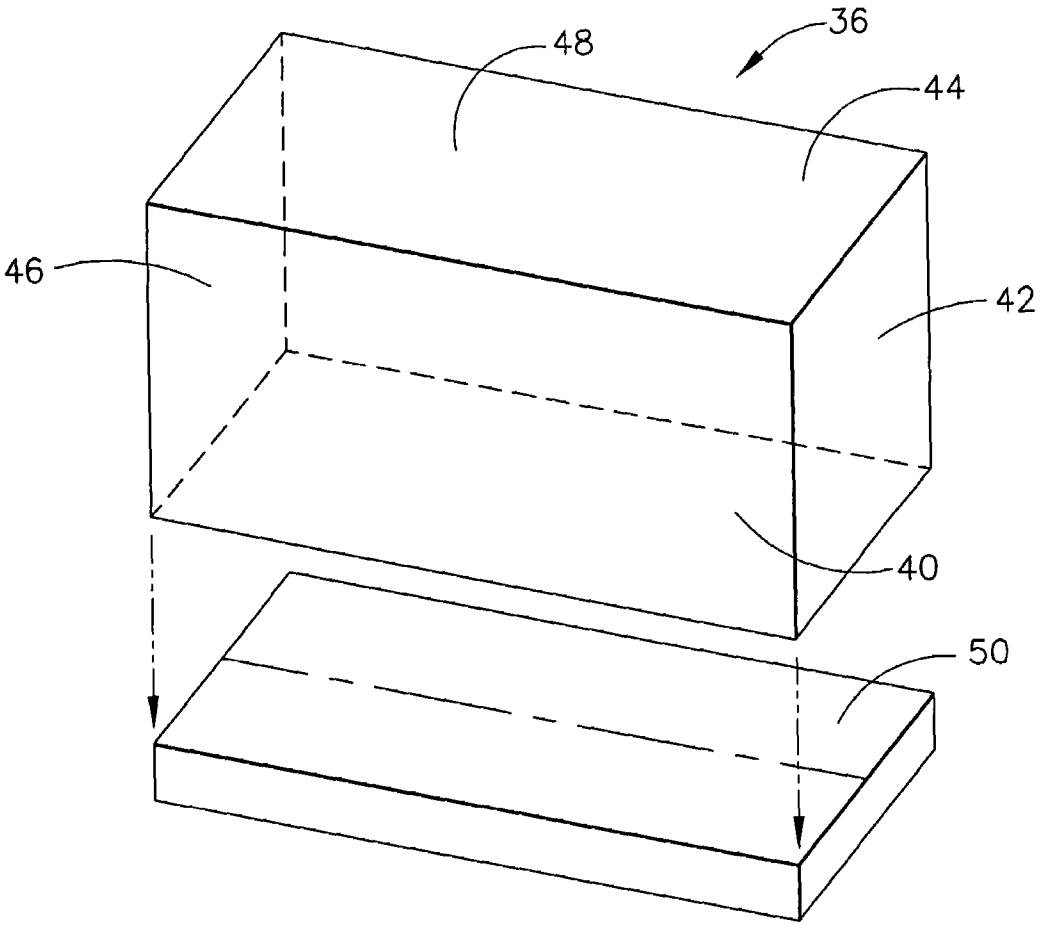
FIG. 3 is perspective view of an exemplary gas turbine module enclosure assembly that includes the gas turbine engine shown in FIG. 2.

FIG. 3 is a perspective view of an exemplary module assembly 36. Although module assembly 36 may be used to enclose any gas turbine engine, in the exemplary embodiment module assembly 36 is used to enclose gas turbine engine 11. In the exemplary embodiment, module assembly 36 includes a first wall 40, a second wall 42 that is coupled to first wall 40, a third wall 44 that is coupled to second wall 42, and a fourth wall 46 that is coupled to third wall 44 and first wall 40 such that module assembly 36 defines an approximately rectangular enclosure that is suitably sized to enclose engine assembly 11. More specifically, first wall 40 is substantially parallel to third wall 44 and also substantially perpendicular to second and fourth walls 42 and 46, respectively and second wall 42 is substantially parallel to fourth wall 46 and substantially perpendicular to first and third walls 40 and 44, respectively. In the exemplary embodiment, module assembly 36 also includes a ceiling 48 and a floor 50 that are each coupled to an upper or lower surface of first, second, third, and fourth walls 40, 42, 44, and 46, respectively such that engine assembly 11 is completely enclosed within module assembly 36.

Figure 4:
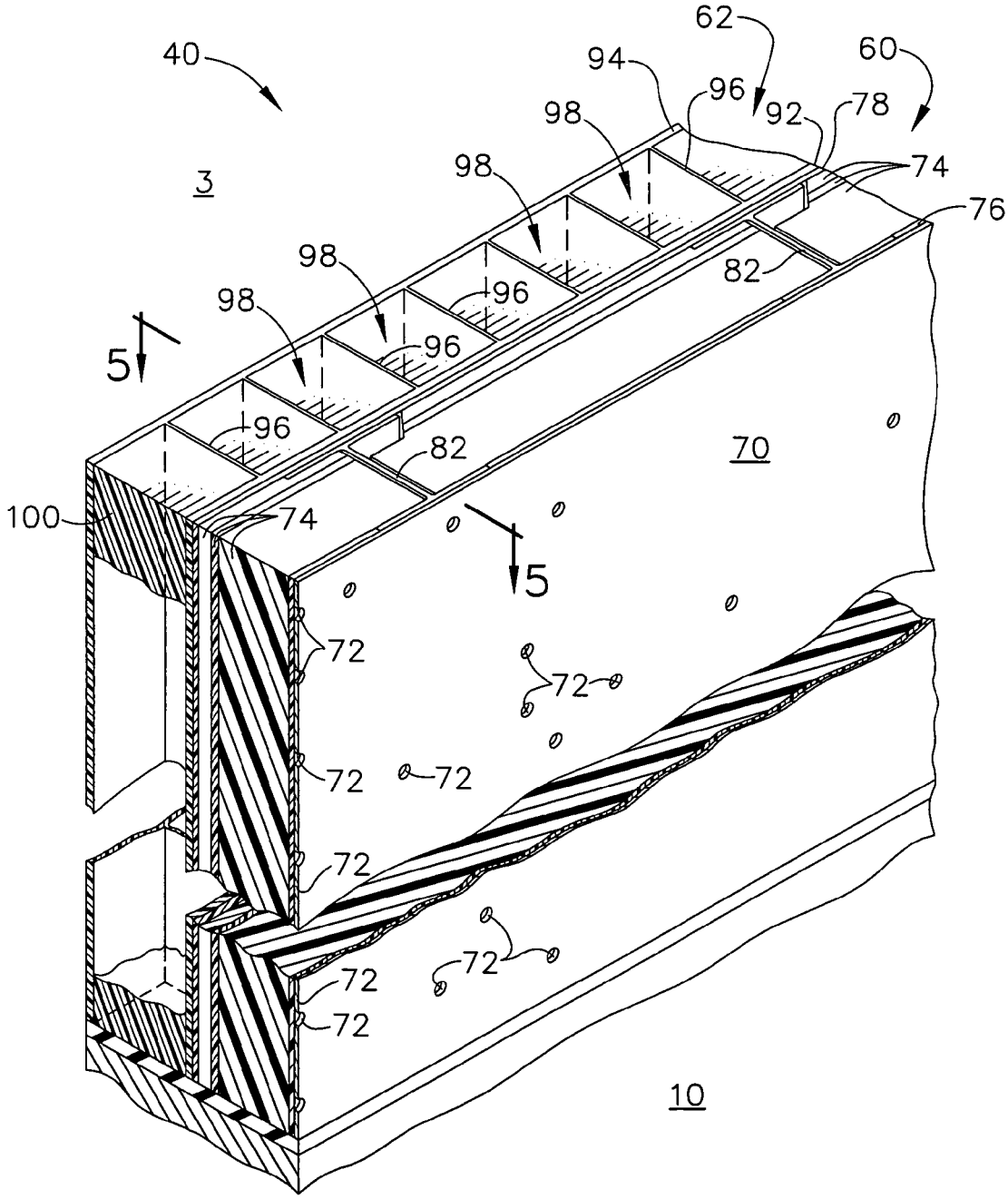
FIG. 4 is a diagrammatic, perspective, fragmentary, partially sectional view of an enclosure wall according to an embodiment of the present invention.
Figure 5:
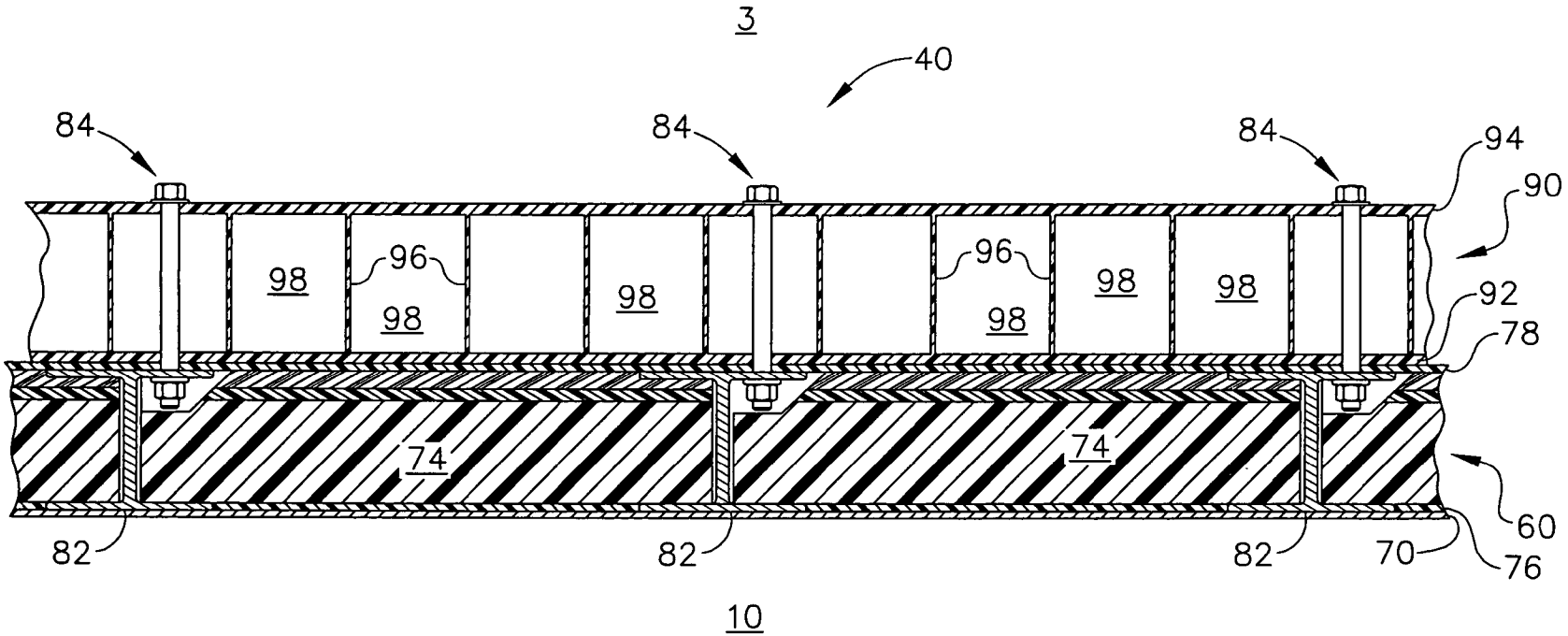
FIG. 5 is a diagrammatic, fragmentary, partially sectional plan view along lines 5-5 of the wall of FIG. 4.

The diagrammatic, perspective, fragmentary, partially sectional view of FIG. 4 and the diagrammatic, fragmentary, partially sectional plan view of FIG. 5 along lines 5-5 of FIG. 4 represents an enclosure wall, shown generally as wall 40 according to an embodiment of the present invention. Although the invention is described with respect to wall 40, it should be realized that walls 42, 44, 46, ceiling 48 or floor 50 may be fabricated using the methods and apparatus described below. Wall 40 includes an inner panel shown generally at 60 and an outer panel shown generally at 62.

Inner panel 60 includes, in sequence outwardly from enclosure hollow interior 10, an inner panel inner sheet 70, typically of a metal such as steel, at hollow interior 10 and including a plurality of perforations 72 therethrough. At sheet 70 is an inner panel sound absorption member 74 substantially made of commercially available non-metallic sound absorption material, for example a polymeric foam or porous material such as is currently made of such materials as polyurethane, rockwool, phenolic, melamine, etc. In FIGS. 4 and 5, member 74 is shown to include a plurality of layers that can be of the same or different materials as desired for sound attenuation. Typically, member 74 includes a thin film facing 76, for example of a metallized polymeric material. Inner panel 60 further includes an inner panel outer sheet 78 substantially made of a non-metallic material, for example of a fiber reinforced resin matrix. In the exemplary embodiment, inner panel 60 also includes a plurality of panel stiffening members 82 that are coupled between inner panel inner sheet 70 and inner panel outer sheet 78. In the exemplary embodiment, each stiffening member 82 is an I-shaped beam that is fabricated from a relatively light-weight composite or metallic material. Preferably, each stiffening member 82 is made substantially of a non-metallic composite material, for example fiber reinforced, to provide a combination of lightweight and strength to wall 40. Optionally, each stiffening member 82 may form generally a "C" shaped channel about sound absorption member 74, although other shapes such as a "Z" shaped channel can be used.

Associated with inner panel 60 is inner panel fastening means shown generally at 84, for example shown as typical bolts, studs, nuts, spacers, and pressure plates. However, fastening means can include interface bonding or adhesive type materials. Fastening means 84 are provided to hold the inner panel inner sheet 70, sound absorption material 74, and inner panel outer sheet 78 in sequence, and to hold stiffening members 82 within inner panel 60.

Outer panel 62 includes, in sequence inwardly from outside 3 of enclosure 36, outer panel sandwich member shown generally at 90 substantially made of a non-metallic composite material, preferably fiber reinforced for enhanced stiffness. Sandwich member 90 includes spaced-apart sandwich member first and second walls 92 and 94, respectively, and a plurality of spaced-apart transverse walls 96 therebetween that define a plurality of hollow chambers 98 therebetween. In the exemplary embodiment, outer panel 62 also includes a plurality of heat, fire resistant, and/or sound absorption cores 100 that are positioned between inner and outer walls 92 and 94 respectively. More specifically, each core 100 is positioned between spaced apart transverse walls 96 within a respective hollow chamber 98. Optionally, outer panel 62 does not include cores 100. In the exemplary embodiment, each core 100 is fabricated using a commercially available non-metallic material, for example a polymeric foam or porous material such as is currently made of such materials as polyurethane, rockwool, phenolic, melamine, etc.

During assembly of wall 40, inner panel 60 is coupled to outer panel 62 using fasteners 84. Specifically, inner panel 60 is coupled to outer panel 62 such that the outer surface of inner panel sound absorption member 74 is flush against the outer surface of second panel second wall 92. That is the exterior surface of inner panel 60 is in contact with, or flush to, the exterior surface of outer panel 62. Optionally, inner panel outer sheet 78 is inserted between panels 60 and 62 to further increase the structural stiffness of the walls and/or to facilitate decreasing noise transmission through the walls.

Described herein is a relatively lightweight enclosure wall that integrates three separate optimized structural elements into one unitized structure. Moreover the enclosure wall has improved acoustic and structural capabilities compared to known enclosure walls. For example, during operation, sound radiating from the gas turbine engine first strikes the surface of the inner panel structure that includes a perforated or solid face sheet backed with a multilayer acoustic absorptive sheet. The multilayer acoustic absorptive sheet may also be subdivided by stiffeners into horizontal or vertical chambers. As such, the inner panel provides acoustic absorptive and transmission loss characteristics.

The enclosure wall also includes an internal skeletal structure that is fabricated utilizing a plurality of beams that acoustically isolate the inner and outer panels, and also provide the primary structural support of the enclosure. The inner and outer panels are fastened to the beams with either mechanical isolation fasteners or bonded with sealants or adhesives. In use, the outer panel provides acoustic transmission loss characteristics, reduced heat flow, fire protection plus in-plane shear loading capabilities. Specifically, the outer panel is fabricated as a sandwich-like structure that includes a pair of composite facesheets that are separated by a medium such as foam or honeycomb, for example. In the exemplary embodiment, the facesheets are connected by both foam and rib stiffeners. The channels between the ribs may be hollow, filled with foam or other sound absorbing media. The high damping and stiffness characteristics of the composite material and sandwich construction facilitate providing an efficient lightweight transmission loss structure. In another embodiment, the wall structure may include a relatively thin metallic plate that is coupled to the outer panel to further increase the transmission loss and also provide fire protection and external damage protection. The low transverse thermal conductivity of composites coupled with the sandwich panel facilitate reducing heat flow and also provides relatively low exterior temperatures.

As a result, the enclosure wall described herein facilitates reducing the overall weight of the engine module structure, provides improved acoustic characteristics, and also reduces outside wall temperatures and fire protection compared to known enclosure walls. As such, the present invention provides an enclosure with a significantly improved combination of reduced weight and structural stability along with sound loss characteristics and heat and fire resistance through the arrangement and use primarily of non-metallic materials. Although the present invention has been described in connection with specific examples, materials and structures, it should be understood that they are intended to be representative of, rather than in any way limiting on, the scope of the present invention. Those skilled in such arts as those relating to sound and heat energy, materials, and enclosure designs will understand that the invention is capable of variations and modifications without departing from the scope of the appended claims.

What is claimed is:

1. A method for assembling a gas turbine engine assembly, said method comprising:

coupling a first wall, a second wall, a third wall, and a fourth wall together to form an enclosure, at least one of the first, second, third, or fourth walls including a first panel including an inner layer, an outer layer, and a plurality of spaced-apart transverse walls between the inner and outer layers, and a second panel that includes at least an outer layer and a first acoustic material, the first panel is secured against the second panel such that an outer surface of the first panel is flush against an outer surface of the first acoustic material; and positioning a gas turbine engine within the enclosure such that at least a portion of the gas turbine engine is contained within the enclosure.

2. A method in accordance with claim 1 further comprising coupling a plurality of panel stiffening members within the second panel to facilitate providing structural support to the wall.

3. A method in accordance with claim 1 further comprising coupling a plurality of substantially I-shaped panel stiffening members within the second panel to facilitate providing structural support to the wall.

4. A method in accordance with claim 1 further comprising positioning a second acoustic material between at least two of the spaced-apart transverse walls.

5. A method in accordance with claim 1 further comprising coupling the first panel to the second panel using a plurality of mechanical fasteners.

6. An enclosure for an apparatus, said enclosure comprising at least one wall defining at least a portion of an enclosure hollow interior, said wall comprising:

an inner panel comprising, in sequence outwardly from the enclosure hollow interior, an inner sheet comprising a plurality of perforations extending therethrough, a plurality of panel stiffening members coupled to said inner sheet, and at least one inner panel sound absorption member comprising a non-metallic sound absorption material positioned between said plurality of panel stiffening members; and an outer panel comprising in sequence inwardly from outside of the enclosure, an outer panel sandwich member comprising non-metallic composite material including spaced-apart first and second walls and a plurality of spaced-apart transverse walls extending between said first and second walls defining hollow chambers therebetween, said outer panel is secured against said inner panel such that an outer surface of said at least one inner panel sound absorption member is substantially flush against an outer surface of said outer panel.

7. An enclosure in accordance with claim 6 wherein said panel stiffening members comprise a plurality of substantially I-shaped panel stiffening members to facilitate providing structural support to said wall.

8. An enclosure in accordance with claim 6 wherein said panel stiffening members are made substantially of a non-metallic composite material.

9. An enclosure in accordance with claim 6 further comprising at least one core fabricated using a porous, non-metallic material, each core positioned substantially within one of said hollow chambers.

10. An enclosure in accordance with claim 6 wherein said inner panel sound absorption member comprises a plurality of layers each made substantially of a non-metallic sound absorption material.

11. An enclosure in accordance with claim 6 wherein said inner panel inner sheet is fabricated using a metallic material, said sound absorption member comprises a plurality of layers each made substantially of non-metallic material, and said the panel stiffening members are made substantially of a non-metallic composite material.

12. A gas turbine engine assembly comprising:

an enclosure including a first wall, a second wall, a third wall, and a fourth wall, each said wall comprising:

an inner panel comprising, in sequence outwardly from the enclosure hollow interior, an inner sheet comprising a plurality of perforations extending therethrough, a plurality of panel stiffening members coupled to said inner sheet, and at least one inner panel sound absorption member comprising non-metallic sound absorption material positioned between said plurality of panel stiffening members; and an outer panel comprising in sequence inwardly from outside of said enclosure, an outer panel sandwich member comprising non-metallic composite material including spaced-apart first and second walls and a plurality of spaced-apart transverse walls extending between said first and second walls defining hollow chambers therebetween, said outer panel is secured against said inner panel such that an outer surface of said at least one inner panel sound absorption member is substantially flush against an outer surface of said outer panel; and a gas turbine engine positioned within said enclosure.

13. A gas turbine engine assembly in accordance with claim 12 wherein said panel stiffening members comprise a plurality of substantially I-shaped panel stiffening members to facilitate providing structural support to said wall.

14. A gas turbine engine assembly in accordance with claim 12 wherein said panel stiffening members are made substantially of a non-metallic composite material.

15. A gas turbine engine assembly in accordance with claim 12 further comprising at least one core fabricated using a porous, non-metallic material, each core positioned substantially within one of said hollow chambers.

16. A gas turbine engine assembly in accordance with claim 12 wherein said inner panel sound absorption member comprises a plurality of layers each made substantially of a non-metallic sound absorption material.

* * * * *

UNITED STATES PATENT AND TRADEMARK OFFICE

CERTIFICATE OF CORRECTION

PATENT NO. : 7,604,095 B2
APPLICATION NO. : 11/444659
DATED : October 20, 2009
INVENTOR(S) : Stephen Craig Mitchell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 534 days.

Signed and Sealed this

Fifth Day of October, 2010

David J. Kappos

David J. Kappos
*Director of the United States Patent and Trademark Office*